US005428931A

United States Patent [19]

Ragsdale

[11] Patent Number: 5,428,931

[45] Date of Patent: Jul. 4, 1995

[54] LAMINATED CONSTRUCTION MODULAR SYSTEM

[76] Inventor: James J. Ragsdale, 5556 S. Washington St., Littleton, Colo. 80121

[21] Appl. No.: 947,438

[22] Filed: Sep. 21, 1992

[51] Int. Cl.[6] ..... E04D 1/00

[52] U.S. Cl. ..... 52/518; 52/416; 52/419; 52/543; 156/71

[58] Field of Search ..... 52/518 OR, 550, 551, 52/552, DIG. 16, 416, 419, 420, 543; 156/71

[56] References Cited

U.S. PATENT DOCUMENTS

| | | | |
|---|---|---|---|
| 1,191,932 | 7/1916 | Loyer | 52/518 |
| 1,593,094 | 7/1926 | Munro | 52/518 |
| 2,379,051 | 6/1945 | Wallace | 52/416 |
| 2,672,831 | 3/1954 | Fink et al. | 52/518 |
| 3,121,649 | 2/1964 | Oliver | 52/419 |
| 3,252,257 | 5/1966 | Price et al. | 52/518 |
| 3,903,340 | 9/1975 | Shepherd | 428/77 |
| 3,921,358 | 11/1975 | Bettoli | 52/419 |
| 4,194,335 | 3/1980 | Diamond | 52/419 |
| 4,592,185 | 6/1986 | Lynch et al. | 52/543 |
| 5,134,831 | 8/1992 | Avellanet | 156/71 |
| 5,238,721 | 8/1993 | Nakazawa | 156/71 |
| 5,253,461 | 10/1993 | Janoski et al. | 156/71 |

*Primary Examiner*—Carl D. Friedman
*Assistant Examiner*—Wynn E. Wood
*Attorney, Agent, or Firm*—Donald W. Margolis; Edwin H. Crabtree; Emery L. Tracy

[57] ABSTRACT

A system for protecting the exterior surface of a static structure, such as a roof, a wall, a fence or other structure, especially those exterior surfaces that are exposed to the ultra violet rays of the sun, to the elements, to ice damning, and to external mechanical stresses. The system is a laminated construction module including a waterproof substrate material which is substantial completed coated on at least its top surface with an adhesive to which the bottom face of one or more exterior protective elements are secured. The protective element is substantially continuously secured, so that should it become cracked, broken or splintered, the fractured portions of the protective element will remain secured to the top of the substrate material without being displaced, thereby protecting the substrate from the elements, from ice damning, and from ultra violet deterioration. In preferred embodiments, the waterproof substrate is in sheet form, the protective element is a plurality of some form of roofing material, and the laminated construction modular system is intended for use on a roof deck.

15 Claims, 2 Drawing Sheets

LAMINATED CONSTRUCTION MODULAR SYSTEM

BACKGROUND OF THE INVENTION (a) Field of the Invention

This invention relates broadly to a modular construction element for protecting the exterior surface of a static structure, such as a roof, a wall, a fence or other structure, especially those exterior surfaces that are exposed to the ultra violet rays of the sun, to the elements, to ice damning, and to external mechanical stresses.

(b) Description of the Prior Art

Waterproofing of exterior walls and roofs is often accomplished by the use of waterproof material such as tar paper, roofing felt, plastic, rubber, reinforced modified bitumen, and any other types of materials that are waterproof, but which will quickly deteriorate if exposed to the ultra violet rays of the sun, to the elements, to ice damning, and to mechanical stress, such as hail or people walking on its surface. Therefore, such waterproof materials are normally covered with an exterior protective element, such as wood shakes or shingles, fiberboard, tile, slate and other materials which provide exterior protection, but which are inherently subject to damage, such as cracking and splintering. When such exterior protective elements are cracked or splintered this may lead to the loss or breaking apart of portions of the exterior protection materials and exposure of underlying portions of the substrate to deterioration due to the elements, to ice damning, and from ultra violet radiation.

In U.S. Pat. No. 5,050,357 to Lawson; U.S. Pat. No. 4,848,057 to MacDonald et al; U.S. Pat. No. 4,731,970 to Marshall et al and U.S. Pat. No. 3,664,081 to Martin et al, various types of multiple shingle structures, building panels, roofing sheets and roofing shingles are disclosed.

In U.S. Pat. No. 3,095,671 to Fink, et al. a multiple shingle structure is shown having a roof sheathing with panels of a thermal insulated material mounted thereon. A water repellant paper sheet and a strip consisting of a layer of glue is disposed on top of and along the length of the thermal insulated material. In this reference, both a discontinuous strip of glue and nails are required to be used to secure shingles on top of the water repellant paper sheet. This reference does not address the problem of loss of portions of shingles, shakes and other protective surface materials following cracking, splintering and breaking apart due, for example, to damage from natural outdoor elements, or from external mechanical damage such as hail or foot traffic on the shingles.

None of the above mentioned prior art patents specifically disclose or teach a laminated construction modular system including a waterproof substrate material which is substantially completed coated on at least its top surface with an adhesive to which the bottom face of one or more exterior protective elements are secured, so that, should the exterior protective elements become cracked, broken or splintered, the fractured portions of the protective element will remain secured to the top of the substrate material without being displaced, thereby protecting the substrate from the elements, from ice damning, and from ultra violet deterioration.

SUMMARY OF THE INVENTION

An object of the present invention is to provide a laminated construction modular system which avoids the loss of shingles, shakes and other protective surface materials, and to the loss of portions of the same following cracking, breaking, splintering due, and breaking apart, for example, due to damage from outdoor elements or from external mechanical damage such as hail or foot traffic.

Another object of the present invention is to provide a laminated construction modular system which limits the loss of even small portions of shingles, shakes and, thereby assures shielding protection of the substructure from ultra violet light, to ice damning, and from the outdoor elements.

Another object of the present invention is to provide a laminated construction modular system which includes a substrate material which is substantially completely coated on its top surface with an adhesive, to which adhesive the bottom face of an exterior protective element is substantially completely secured in a manner such that, should the protective element become cracked, broken or splintered, the fractured portions of the protective element will tend to remain secured to the top of the substrate material by the adhesive without being displaced, thereby continuing to protect the substrate from the elements and from ultra violet deterioration, and ice damning.

Yet another object of the present invention is to provide such a modular system in which the substrate is waterproof material such as plastic, rubber, reinforced modified bitumen (bituminous resins modified with synthetic resins), metal and any other types of materials that are waterproof and which are normally disposed adjacent to the exterior of a structure, and in which the exterior element is wood shakes or shingles, composition shingles, fiberboard, tile, slate and other materials which provide exterior protection, but which are inherently subject to damage, such as cracking, splintering and breaking apart, which, but for the adhesive, may experience the loss of portions of the exterior protection materials and exposure of underlying portions of the substrate to deterioration due to the elements, from ice damning, and from ultra violet radiation.

Yet another object of the present invention is to provide such a modular system in which the waterproof substrate is in sheet form, the protective element is some form of roofing material which is subject to damage, such as cracking, splintering, and breaking apart, and the laminated construction modular system is intended for use on a roof deck.

Still another object of the present invention is to provide such a roof deck laminated construction modular system which is constructed with the waterproof substrate coated with adhesive on its top surface, and possibly on at least a portion of its bottom surface.

Still another object of the present invention is to provide a method of making such a roof deck laminated construction modular system which is constructed from a waterproof substrate coated with adhesive on at least its top surface, and with the adhesive covered with an easily removable sheet until such time as it is desired to expose the adhesive in order to adhere either the bottom surface of the substrate to a roof deck, and/or to expose the adhesive on the top surface of the substrate in order to adhere protective shingle material to the top surface.

A further object of the present invention is to provide one form of such a roof deck laminated construction modular system which is constructed to prevent heavy winds from engaging the undersurface of a portion of the protective roof shingle material.

An additional object of the present invention is to provide such a laminated construction modular roof system, which, through its use of substrate material and adhered protective roof material diminishes the need to use roofing felt and similar materials on a roof deck.

A further object of the present invention is to provide such a laminated construction modular system which is constructed to restrict damage from occurring due to winds by adhering to the bottom of the substrate material another type of waterproof membrane that is self-adhering, and which extends past the tips of the exterior protective element and then folds around the tip and over the top of the exterior protective element adhering to it then adhering to the bottom of the substrate of the next over lapping laminated construction module at its butt.

Still another object of the present invention is to provide such a laminated modular system which is constructed to prevent water damage to roof decking from occurring due to water backing up the roof slope due to ice damning by the butts of the over lapping laminated construction modular systems which are adhered to the tops of the previously installed construction modular systems by having either the waterproof substrate material or another type of waterproof self adhering material wrapped around its tip.

These and other objects are accomplished by the use of the laminated construction modular system of the present invention. The laminated construction modular system of the present invention includes a waterproof substrate material which is substantial completed coated on at least its top surface with an adhesive to which the bottom face of exterior protective elements is secured. The exterior protective element is substantially continuously secured in a manner such that, should the protective element become cracked, broken or splintered, the fractured portions of the protective element will tend to remain secured to the top of the substrate material without being displaced, thereby continuing to protect the substrate from the elements, from ice damning, and from ultra violet deterioration. In preferred embodiments, of the present invention the waterproof substrate is in sheet form, the protective element is a plurality of some form of roofing material and the laminated construction modular system is intended for use on a roof deck or wall, and as such provides waterproofing to a roof deck or wall, as well as protection of the roofand wall against wind, rain, hail, snow, ice and ultra violet light.

In one preferred embodiment of the present invention the roof deck laminated construction modular system which is constructed with the substrate coated with adhesive on both its top surface and possibly on at least a portion of its bottom surface. Whether the substrate is coated with adhesive on only the top surface, or is coated with adhesive on both its top surface and its bottom surface, the adhesive is preferably covered with a removable sheet until such time as it is desired to expose the adhesive. The adhesive on the bottom surface of the substrate may also be, but need not be, exposed in order to adhere the substrate to a roof deck. The adhesive on the top surface of the substrate will normally be exposed in order to adhere the protective shingle material to the top surface of the substrate. Composite materials, which combine a waterproof substrate and adhesive are available commercially, one such product being "ICE AND WATER GUARD" from Protecto Wrap Company.

As detailed below, through the use of the adhesive coating, the system of the present invention prevents the loss of shingles, shakes and other protective surface materials, and also prevents the loss of portions of the same following cracking, breaking and splintering due, for example, to damage from outdoor elements or from external mechanical damage such as hail or foot traffic, thereby providing continuous protection to the substrate material. As the laminated construction modular system avoids the loss of shingles, shakes and other protective surface materials, it thereby assures protection of the substrate material from ultra violet light, from ice damning, and from the elements. The use of the adhesive coating on the top surface of the substrate induces the entire bottom face of the protective material to be secured to the substrate material. This eliminates any of the underside surface of the protective material from being exposed to being attacked by the wind. Also because the entire surface of the bottom face of the protective roof material is secured to the top of the substrate material, strong winds are prevented from lifting up a portion of, for example, the butt end of the shingles, so that the shingles are not displaced from the surface of the roof.

In a preferred form of the present invention, such a roof deck laminated construction modular system is constructed to prevent heavy winds from engaging the undersurface of a portion of the protective roof shingle material. This is accomplished by utilizing a substrate which is coated with adhesive on both its top surface and its bottom surface, and with a portion of the substrate extending beyond the tip of the protective roof shingle material. The portion of the substrate which extends beyond the tip of the protective roof material is folded around that tip and over the top of the protective roof material to thereby adhere to and cover the tip ends of the protective material and a portion of the top of the protective material. In this configuration the adhesive which had been on the bottom of the substrate is now on the top of the protective roof material, where it can now serve to secure the underside of the butt ends of an overlapping row of protective material to the topside of the tip ends of an adjacent overlapping row of protective material.

In a preferred embodiment of the present invention, the roof deck laminated construction modular system is constructed from a waterproof substrate coated with adhesive on at least its top surface, which adhesive is covered with an easily removable sheet material, such as a plastic film, until such time as it is desired to expose the adhesive in order to adhere either the bottom surface of the substrate to a roof deck, and/or to expose the adhesive on the top surface of the substrate in order to adhere protective material to the top surface.

In one form of the present invention, such a laminated modular system is constructed to prevent water damage to roof decking from occurring due to water backing up the roof slope due to ice damning by the butts of the over lapping laminated construction modular systems which are adhered to the tops of the previously installed construction modular systems by having either the waterproof substrate material or another type of waterproof self adhering material wrapped around its tip. By wrapping the substrate material or adding another type of self adhering waterproof membrane to the bottom of the substrate and wrapping it around tips and over the top of the exterior protective element, the upward migration of water due to ice damning is stopped. Composite materials, which combine a waterproof substrate and adhesive, such as "ICE AND WATER GUARD" from Protecto Wrap Company may also be used as such a wrap.

As detailed below, the laminated construction modular system roof system of the present invention, through its use of substrate material and protective roof material secured thereto, diminishes the need to use roofing felt and similar materials on a roof deck.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
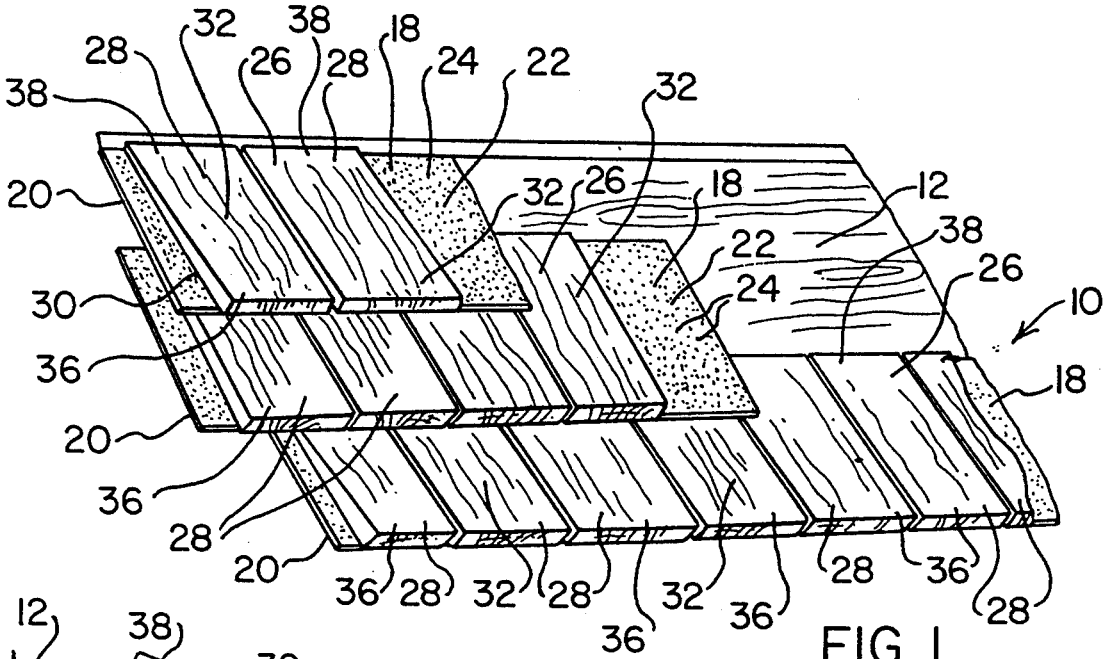
FIG. 1 is a perspective view of a portion of a roof deck with the subject laminated construction modular system of the present invention installed thereon, with wooden shakes used as the exterior protective material.
Figure 2:
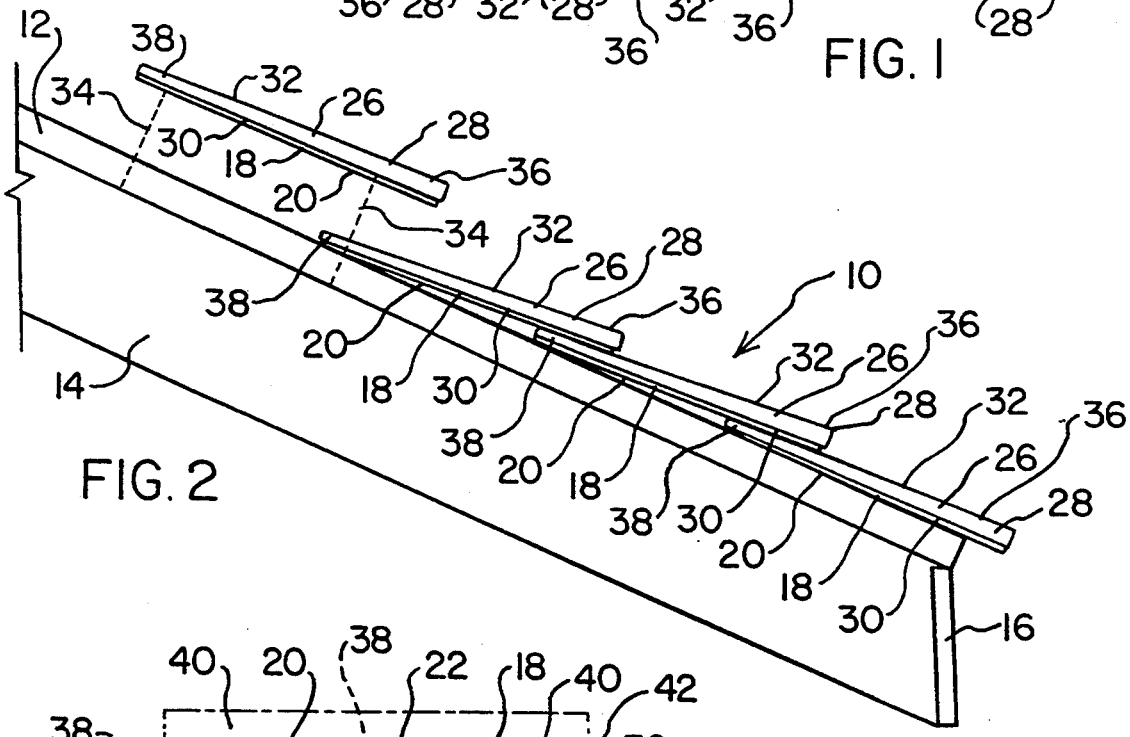
FIG. 2 illustrates a side view of a portion of a roof deck, similar to that shown in FIG. 1, with three rows of the laminated construction modular roof system installed and a fourth row in position above the roof deck, ready for installation.

Referring to FIGS. 1 and 2, the subject laminated construction modular system is shown in the form of a roofing system having a general reference numeral 10. The laminated construction modular roofing system 10 is disposed on and secured to the top of a roof deck 12 supported by roof truss 14 and fascia board 16. The laminated construction modular system 10 includes a substrate sheet material 18, which may be made of plastic, rubber, reinforced modified bitumen, metal or any other type of membrane material that is substantially impervious to water and moisture penetration. The waterproof sheet material 18 includes a bottom surface 20, which is received on top of the roof deck 12 and a top surface 22 which is coated with an adhesive coating 24, indicated by small dots in the drawings. A plurality of exterior protective material elements 26 are disposed on the adhesive coating 24 on top surface 22 of substrate sheet material 18. The exterior protective material elements 26 are secured to the sheet material 18 by the adhesive coating 24 to form one preferred embodiment of the laminated construction modular system 10 of the present invention.

Figure 3:
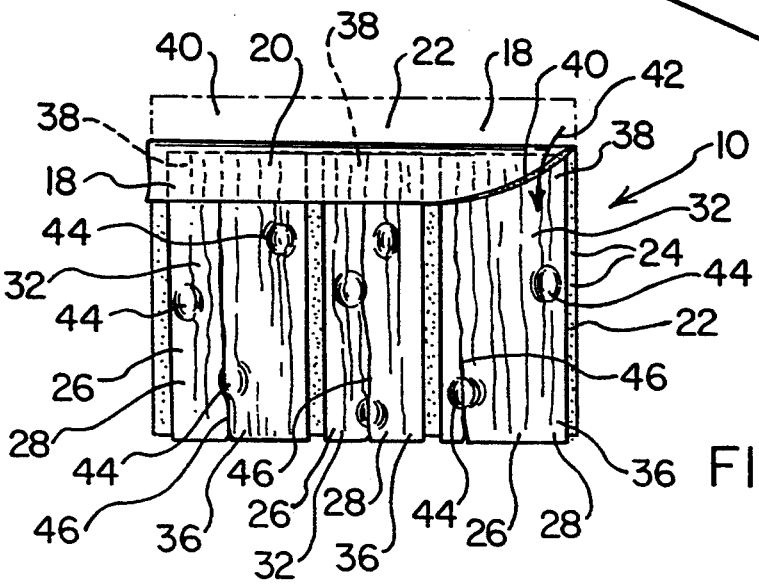
FIG. 3 illustrates a top view of a portion of the roof system, showing three shake shingles secured to the top of the substrate material, and with a portion of the substrate material shown in phantom extending beyond the shingles, and also showing the same extended portion of the substrate material folded over the top of the tip ends of the shakes.

In FIGS. 1–3 the exterior protective material elements are shown as wood shakes 28. While the wood shakes 28 are shown, the exterior protective material could also be wood or composition shingles, fiberboard, different types of tile and slate, and other common roofing materials used to protect a lower substrate sheet material, such as roofing felt and the like. The bottom face 30 of each wood shake 28 is substantially completely secured to the adhesive coating 24 on the sheet material 18, while the top faces 32 of the wood shakes 28 are exposed to the suns rays and the elements. The exterior protective roof material 26 is designed to protect the sheet material 18 from the ultra violet rays of the sun, which would normally cause sheet material 18, to deteriorate over a shorter period of time, and to also protect roof deck 12 from foot traffic.

In FIG. 2, a side view of the roof system 10 is shown with three rows of laminated construction modular systems 10 composed of wood shakes 26 adhesively secured to sheet material 18 and installed on the roof deck 12. A fourth laminated construction modular system 10, also composed of wood shake 28 and sheet material 18 covering the bottom face 30 of the shake 28, is disposed above roof deck 12, ready for mounting. In the side view of FIG. 2, adhesive coating 24 is too thin to be seen in this scale. The laminated construction modular systems 10 may be secured to roof deck 12 using nails, staples or any other type of securing means used in the roofing industry. In the view of FIG. 2, a butt end 36 of the shakes 28 and associated sheet material 18 which make up each laminated construction modular system 10 can be seen to be overlapped on top of a tip end 38 of a lower row of shakes 28 of a lower laminated construction modular system 10. In FIG. 3, a top view of the laminated construction modular roof system 10 is shown wherein a top portion 40 of the sheet material 18, as shown in phantom extending above the tip ends 38 of shakes 28. Top portion 40 is also shown in solid lines folded, as indicated by arrow 42, over and on top of the tip ends 38, also shown in phantom of shakes 28, thereby further securing the shakes 28 to sheet material 18. In FIG. 3, shakes 28 are shown with a number of dimples 44 in their top faces 32, which dimples 44 are caused, for example, by hail damage. Because of the hail damage, shakes 28 are shown as having cracks 46 running the length of each shake. It should be noted that even though shakes 28 have been damaged and cracked, because shakes 28 are substantially continuously held in place by adhesive coating 24 on sheet material 18, they remain in place, and will resist falling off or being blown away by the wind. Heretofore, prior art roof systems provided no substantially complete adhesive coating on a waterproof sheet material for securing substantially the entire backside of the exterior protective roof material 26. Therefore any broken or cracked shake, shingle or roof tile, would, in time come loose and fall from the roof or be blown away, leaving the waterproof sheet material or roof felt exposed to deterioration by the ultra violet rays of the sun, ice damning, and to the weather elements. Now that the present invention secures substantially the entire backside of the protective roof material 26 to sheet material 18, deterioration of sheet material 18, and subsequent damage to roof deck 12 is prevented, thereby maintaining the waterproof quality of the roof.

Figure 4:
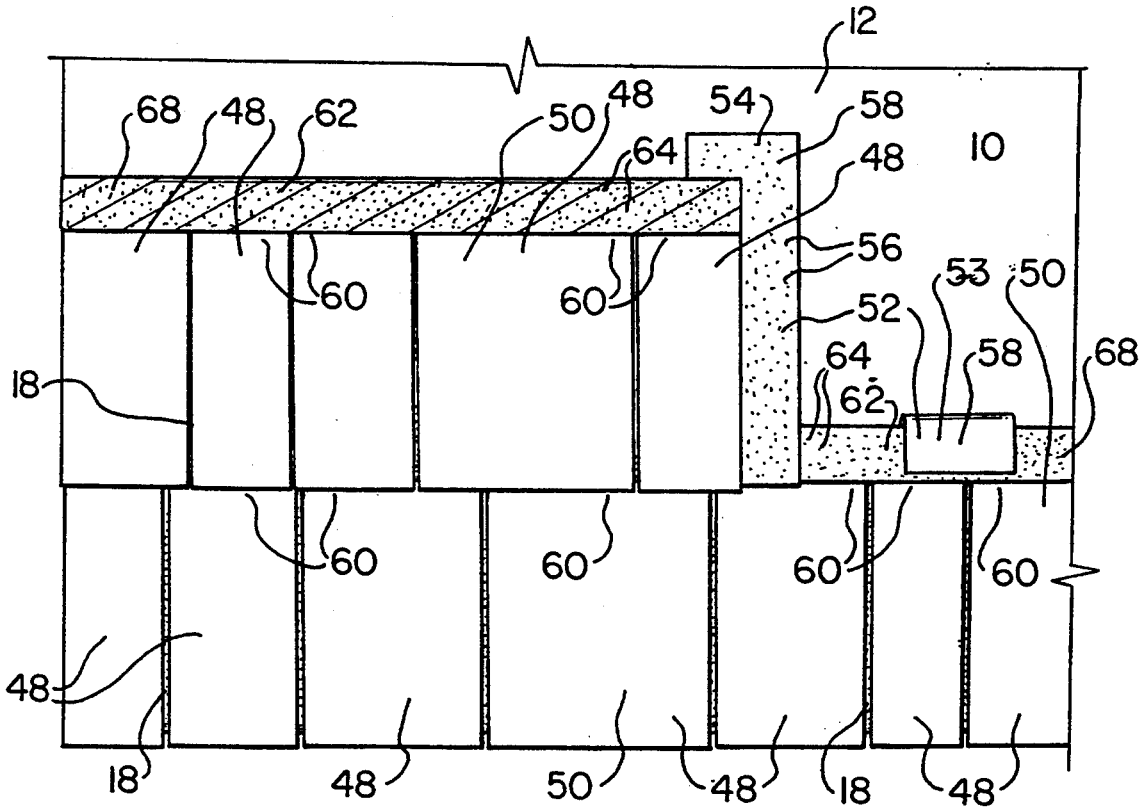
FIG. 4 is a top view of two rows of laminated construction modular system roofing material secured to a roof deck, each row of laminated construction modular system roofing material having a portion of substrate material having adhesive on its bottom surface disposed around the tip ends of the shingles, as in FIG. 3, and with an overlapping of a portion of the top modular system on the adhesive portion of the bottom modular system in a manner such that a portion of the bottom of the top modular system is secured to the top of the bottom modular system by the adhesive.

In FIG. 4 a front view of two rows of shingles 48 is shown secured to top surface 22 of sheet material 18 using adhesive coating 24. As in the previous examples, shingles 48 may be made of wood, composition, and like material. In this illustration, roofing system 10 includes prefabricated panels 50 of shingles 48 which are substantially continuously adhered to sheet material 18. Prefabricated panels 50 may be cut to various lengths and may include a single row of shingles 48, as shown in FIG. 4, or may include multiple rows of shingles 48 on a single membrane of sheet material 18. In the view shown in FIG. 4, opposite ends of panels 50 are joined together by a lap joint element 52 made of a water proof sheet material 54 coated with an adhesive 56. Lap joint element 52 may be made of material similar to sheet material 18. The joining together of abutting ends of adjoining panels 50 is shown in the lower row in which two panels 50 are shown joined together using lap joint 52, with an upper portion 53 of lap joint element 52 folded over tip ends 60 of shingles 48.

Figure 6:
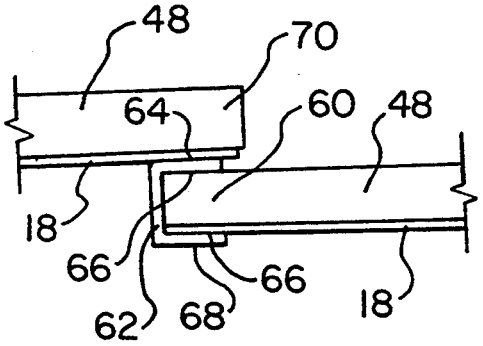
FIG. 6 is an enlarged side sectional view of the shingles shown in FIG. 5 wherein the bottom side of the butt end of an upper shingle is adhered to the top side of the tip end of a lower shingle.

An ice and water proof membrane 62, such as ICE AND WATER GUARD, is also shown in FIG. 4 attached to the bottom surface 20 of sheet material 18 and folded over and on top of shingle tip ends 60. The membrane 62 is made of a water proof plastic membrane sheet material, which may be similar to sheet material 18. The membrane 62 includes both an adhesive coating 64 on its bottom surface 66, as shown in FIG. 6, and on its top surface 68. Therefore, membrane 62 is armed with a sticky or adhesive coating for engaging tip ends 60 of shingles 48 and also butt ends 70 of an upper row of shingles 48, as shown in FIGS. 5 and 6.

Figure 5:
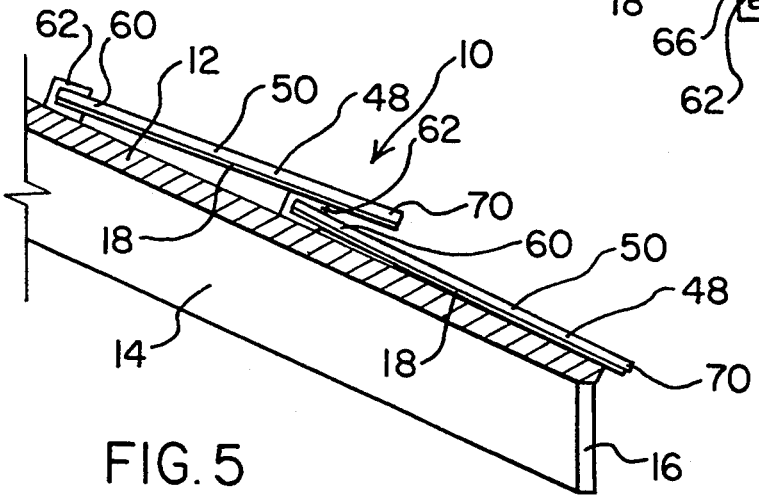
FIG. 5 is a side sectional view of the two rows of modular systems secured to a roof deck, with an adhesive substrate adhered to the bottom of a shingle and the substrate on which it rests, and wrapped around the tip of the shingle and secured to the top surface.

In FIG. 5, a side view of roof system 10. In this view, butt ends 70 of lower panel 50 of shingles 48 are shown extending outwardly over the edge of roof deck 12 and above fascia board 16. Both of the panels 50 in FIG. 5 are shown with membranes 62, with butt ends 70 of the upper panel 50 disposed above the tip ends 60 of lower shingles 48.

In FIG. 6, an enlarged side view of the tip end 60 of a lower shingle 48 and butt end 70 of upper shingle 48 is shown. As mentioned above, ICE AND WATER GUARD membrane 62 has a double sided adhesive coating 64 on both bottom surface 66 and top surface 68. In this view, butt end 70 of shingle 48, with sheet material 18 on its bottom surface, can be seen secured to the top of tip end 60 of lower shingle 48 using adhesive coating 64 on the top surface 68 of membrane 62.

The laminated construction modular system 10 can be prefabricated by first applying the adhesive coating 22 to the top surface 24 of a selected waterproof sheet material 18. The sheet material 18 may be cut to various lengths and widths depending on how it is to be shipped and depending on the size of the structure that it is to cover. For example, sheet material 18 may be cut so that a single row of a plurality of exterior protective roof material elements 26 can be secured thereon, or sheet material 18 can be cut to a width for securing a plurality of rows of exterior protective roof material elements 26. To make sure that the exterior protective roof material 26 is properly secured to the top surface 24 of the sheet material, if the adhesive coating 24 is thermoplastic, it may be heated above the ambient temperature prior to applying the exterior protective material 26 thereon. Once material 26 is applied and adhesive coating is allowed to cool, the material 26, such as shakes 28 or shingles 48 shown in the drawings, is firmly secured to sheet material 18. The laminated construction modular system roofing system 10 may be built to specific size specifications, or it may be built with large dimensions and then cut to length. In any event, prefabricated modular systems 10 may be transported to a job site for installation on a roof deck 12, as shown in FIGS. 1 and 4, or on other exterior surfaces.

In a preferred form of the present invention, such a roof deck laminated construction modular system 10 is constructed to prevent heavy winds from engaging the undersurface of a portion of the protective roof shingle material 28. This is accomplished by utilizing a substrate surface 22 which is coated with adhesive 24 on both its top an bottom surfaces. The protective roof shingle material 28 is placed on top surface 24 in a way such that a portion of the substrate sheet material 18 extends beyond the tip 60 of the protective roof shingle material 26. The portion of the substrate sheet material 18 which extends beyond the tip 60 of the protective roof material 28 is folded around tip 60 and over the top of the protective roof material 28 to thereby adhere to and cover the tip end 60 of the protective material 60 and a portion of the top of the protective material 28. In this configuration the adhesive 24 which had been on the top of the substrate 18 is now on the top of the protective roof material, where it can now serve to secure the underside of the butt ends 70 of an overlapping row of protective material to the topside of the tip ends 60 of an adjacent overlapping modular system 10.

In another preferred embodiment of the present invention, the roof deck laminated construction modular system 10 is constructed from a waterproof substrate 18 coated with adhesive 24 on at least its top surface 22, which adhesive is covered with an easily removable sheet material, such as a plastic film, until such time as it is desired to expose the adhesive in order to expose the adhesive 24 on the top surface 22 of the substrate sheet material 18 in order to adhere protective material 26 to top surface 22.

It is therefore seen that the present invention provides a laminated construction modular system which avoids the loss of shingles, shakes and other exterior protective surface materials, and the loss of even small portions of the same following cracking, breaking and splintering due, for example, to damage from outdoor elements or from external mechanical damage such as hail or foot traffic, thereby assuring shielding protection of the substructure from ultra violet light, from ice damning, and from the elements. This is accomplished by providing a laminated construction modular system which includes a substrate material which is substantially completely coated on at least its top surface with an adhesive to which the bottom face of an exterior protective element is secured in a manner such that, should the exterior protective element become cracked, broken or splintered, the fractured portions of the exterior protective element will tend to remain secured to the top of the substrate material by the adhesive without being displaced, thereby continuing to protect the substrate from the elements and from ultra violet deterioration and ice damning. The present invention provides such a modular system in which the substrate is waterproof material such as plastic, rubber, reinforced modified bitumen, metal and any other types of materials that are waterproof and which are normally disposed adjacent to the exterior of a structure, and in which the exterior element is wood shakes or shingles, composition shingles, fiberboard, tile, slate and other materials which provide exterior protection, but which are inherently subject to damage, such as cracking and splintering which, but for the adhesive, may experience the loss of portions of the exterior protection materials and exposure of underlying portions of the substrate to deterioration due to the elements and from ultra violet radiation and ice damning. The present invention has taught preferred embodiments of such modular systems in which the waterproof substrate is in sheet form, the exterior protective element is some form of roofing material which is subject to damage, such as cracking and splintering, and the laminated construction modular system is intended for use on a roof deck. Such laminated construction modular systems have been shown to be constructed with the waterproof substrate coated with adhesive on its top surface and on at least a portion of its bottom surface. In another preferred embodiment, such modular systems have been taught which are constructed to prevent heavy winds from engaging the undersurface of a portion of the exterior protective roof shingle material. It has been shown that the laminated construction modular roof system, which, through its use of substrate material and adhered exterior protective roof material diminishes the need to use roofing felt and similar materials on a roof deck.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A laminated construction modular system, including in combination:

a waterproof substrate sheet material having a top surface and a bottom surface;

adhesive coated on at least said top surface of said waterproof substrate sheet material; and a plurality of exterior protective elements, each exterior protective element having an upper edge, a lower edge, a pair of opposed side edges between said upper edge and said lower edge, a top surface and a bottom surface, wherein substantially said entire bottom surface which corresponds, at least, to the exposed top surface of each said exterior protective element is secured to said top surface of said waterproof substrate sheet material by said adhesive material coated on said top surface of said substrate sheet material, and with said plurality of protective elements being thereby held in horizontal rows, side edge by side edge to each adjacent protective element to form a laminated construction modular system in a manner such that, should any of said protective elements become cracked, broken or splintered, the fractured portions of said protective elements will tend to remain secured to said top of said substrate sheet material by said adhesive material without being displaced, thereby continuing to protect said substrate from the elements, from ice damming, and from ultra violet deterioration.

2. The laminated construction modular system of claim 1 in which said waterproof substrate and said adhesive is a composite element.

3. The laminated construction modular system of claim 1 in which said sheet of waterproof substrate is flexible.

4. The laminated construction modular system of claim 2 in which said substrate is selected from the group consisting of plastic, rubber, reinforced modified bitumen, and metal.

5. The laminated construction modular system of claim 1 in which said protective element is roofing material, and said laminated construction modular system is adapted for use in horizontal rows on a roof deck to provide waterproofing and protection of such a roof deck against wind, rain, hail, snow, ice and ultra violet light by preventing the loss of exterior protective elements.

6. The laminated construction modular system of claim 5 in which said exterior element is roof shingle material selected from the group consisting of wood shakes, wood shingles, composition shingles, fiberboard, tile, and slate.

7. The laminated construction modular system of claim 6 in which said laminated construction modular roof system is constructed to prevent heavy winds from engaging the undersurface of a portion of said protective roof shingle material wherein said substrate sheet material is of a length in excess of the length of said protective roof shingle material, and with said excess length of said substrate coated on both its said top surface and its said bottom surface with adhesive, said excess length of said same substrate sheet material being folded around said upper edge of said protective roof material and over said top of said protective roof shingle material to thereby adhere to and cover said upper edge and a portion of said top of said protective roof material with said same substrate sheet material, in a manner such that it presents an adhesive surface on its top surface edge which is available to secure the underside of any overlapping modular system.

8. The laminated construction modular system of claim 7 in which said laminated construction modular roof system is constructed to prevent water damage to roof decking from occurring due to water backing up the roof slope due to ice damming by said lower edge of said shingles of the over lapping laminated construction modular systems which are adhered to said tops of the previously installed construction modular systems by having said waterproof self adhering material wrapped around said upper edge, and over said top surface of each said shingle exterior protective element, whereby the upward migration of water due to ice damming is stopped.

9. A modular system for providing weather protection to the exterior of a static structure, the system comprising:

a waterproof sheet material having a top surface and a bottom surface, said bottom surface being adapted to engage the exterior of a static structure;

a plurality of protective material elements, each protective material element having a top surface and a bottom surface; and adhesive securing means covering said top surface of said waterproof sheet material and engaging and holding substantially said entire bottom surface of each said exterior protective material clement disposed on said top surface of said waterproof sheet material in side-by-side horizontal relation to provide a modular weather protection system.

10. The system as described in claim 9 wherein said waterproof sheet material is in the form of a sheet substrate made of plastic, rubber, reinforced modified bitumen, and metal.

11. The system as described in claim 9 wherein each said exterior protective material element is roof shingle material selected from the group consisting of wood shakes, wood shingles, composition shingles, fiberboard, tile, and slate.

12. The system as described in claim 11 wherein said securing means is applied to said top surface of said waterproof sheet material, said adhesive coating securing substantially said entire bottom surface of said exterior protective roof shingle material to said waterproof sheet material.

13. The system as described in claim 11 wherein each said exterior protective roof material element includes a tip end and a butt end and said butt ends of an upper row of one modular system overlap on top of said tip ends of a lower row of another modular system.

14. The system as described in claim 13 further including means for securing said butt ends of said upper row of one modular system to said tip ends of said lower row of another modular system.

15. The system as described in claim 14 wherein said means for securing and said waterproof substrate is a composite element.

* * * * *